US010590932B2

(12) United States Patent
Kösters et al.

(10) Patent No.: US 10,590,932 B2
(45) Date of Patent: Mar. 17, 2020

(54) FLUID RING COMPRESSOR

(71) Applicant: Sterling Industry Consult GmbH, Itzehoe (DE)

(72) Inventors: Heiner Kösters, Itzehoe (DE); Inke Wrage, Neuenkirchen (DE); Jorg Wickbold, Lunden (DE); Stefan Lähn, Looft (DE)

(73) Assignee: Sterling Industry Consult GmbH, Itzehoe (DE)

( * ) Notice: Subject to any disclaimer, the term of this patent is extended or adjusted under 35 U.S.C. 154(b) by 411 days.

(21) Appl. No.: 15/319,036

(22) PCT Filed: Jun. 16, 2015

(86) PCT No.: PCT/EP2015/063481
§ 371 (c)(1),
(2) Date: Dec. 15, 2016

(87) PCT Pub. No.: WO2015/193318
PCT Pub. Date: Dec. 23, 2015

(65) Prior Publication Data

US 2017/0130718 A1 May 11, 2017

(30) Foreign Application Priority Data

Jun. 18, 2014 (EP) ..... 14173028

(51) Int. Cl.
*F04C 19/00* (2006.01)
*F04C 23/00* (2006.01)
(Continued)

(52) U.S. Cl.
CPC ..... *F04C 19/007* (2013.01); *F04C 23/001* (2013.01); *F04C 27/001* (2013.01);
(Continued)

(58) Field of Classification Search
CPC ..... F04C 19/00; F04C 19/001; F04C 19/002; F04C 19/004
(Continued)

(56) References Cited

U.S. PATENT DOCUMENTS 4,323,334 A * 4/1982 Haavik ..... F04C 19/004 417/244
6,347,926 B1 * 2/2002 Pyrhonen ..... F01C 7/00 417/356
(Continued)

FOREIGN PATENT DOCUMENTS

DE 890256 9/1953
DE 923571 2/1955
(Continued)

OTHER PUBLICATIONS

Search Report.

*Primary Examiner* — Patrick Hamo
(74) *Attorney, Agent, or Firm* — Alix, Yale & Ristas, LLP

(57) ABSTRACT

A fluid ring compressor comprises a first single-acting compression stage having a first impeller eccentrically mounted in a housing and a second single-acting compression stage having a second impeller eccentrically mounted in a housing. The first compression stage and the second compression stage are separated from one another by a sealing gap. The sealing gap is arranged between a suction section of the first compression stage and a suction section of the second compression stage.

21 Claims, 6 Drawing Sheets

(51) Int. Cl.
*F04C 27/00* (2006.01)
*F04C 29/00* (2006.01)

(52) U.S. Cl.
CPC ..... *F04C 29/0035* (2013.01); *F04C 29/0078* (2013.01); *F04C 2240/20* (2013.01); *F04C 2240/30* (2013.01); *F04C 2240/605* (2013.01)

(58) Field of Classification Search
USPC ..... 417/68
See application file for complete search history.

(56) References Cited

U.S. PATENT DOCUMENTS

| | | | | |
|---|---|---|---|---|
| 8,740,575 | B2 * | 6/2014 | Bissell | F01C 21/10 417/68 |
| 2001/0026759 | A1 * | 10/2001 | Kraner | F04C 19/00 417/68 |

FOREIGN PATENT DOCUMENTS

| | | |
|---|---|---|
| DE | 1004334 | 3/1957 |
| DE | 1428139 | 12/1968 |
| DE | 8906100 | 6/1989 |
| FI | 46204 | 2/1972 |
| FR | 1113561 | 3/1956 |
| GB | 1011451 | 12/1965 |

* cited by examiner

FLUID RING COMPRESSOR

BACKGROUND

The invention relates to a fluid ring compressor having a first compression stage, which has a first impeller eccentrically mounted in a housing, and a second compression stage, which has a second impeller eccentrically mounted in a housing. Both compression stages are single-acting. A sealing gap separates the first compression stage from the second compression stage.

In fluid ring compressors, a fluid ring is kept in motion by the impeller, with the result that the chambers between the blades of the impeller are closed off by the fluid ring. Since the impeller is mounted eccentrically in the housing, the fluid ring penetrates by different amounts into the chamber, depending on the angular position of the impeller, and thereby acts as a piston which changes the volume of the chamber. In the angular range in which the volume of the chamber is small, the gas to be compressed enters the chamber. As the impeller is rotated, the volume of the chamber decreases and the compressed gas emerges again in a different angular position of the impeller at the end of the compression process.

By connecting a plurality of compression stages in series in a compressor, it is possible to produce an increased pressure difference between the inlet side and the outlet side of the compressor. The gas drawn in on the inlet side is compressed by the first compression stage. From the outlet side of the first compression stage, the gas passes to the inlet side of the second compression stage so as to be compressed further there.

If the first compression stage and the second compression stage are separated from one another only by a sealing gap, very compact construction of the fluid ring compressor is possible.

However, a leakage flow through the sealing gap can arise owing to the pressure difference between the first compression stage and the second compression stage. Such a leakage loss has a negative effect on the efficiency of the compressor.

SUMMARY

A fluid ring compressor of improved efficiency is provided.

The sealing gap is arranged between a suction segment of the first compression stage and a suction segment of the second compression stage.

A number of terms will first of all be explained. The term "sealing gap" is used to denote the transitional region between two compressor components that move relative to one another. The sealing gap is designed in such a way that the transfer of a medium through the sealing gap is severely restricted.

The term "suction segment" denotes a circumferential segment of the compressor. When a chamber of the impeller passes through the suction segment, the chamber volume enclosed between the blades and the fluid ring increases in size. In the suction segment, the gas to be compressed is fed to the chamber.

In the case of a single-acting compression stage, there is just one compression process during a complete revolution (360°) of a chamber of the impeller. Thus, the chamber passes through just one suction segment and one pressure segment. The compression process normally extends over a circumferential angle of more than 180°. In the case of a double-acting compression stage, in contrast, a first suction segment and a first pressure segment are traversed first of all, and then a second suction segment and a second pressure segment, during one complete revolution. The individual compression process extends over less than 180°.

Since the compressor is designed in such a way that the suction segments of the two compression stages adjoin one another, the pressure difference across the sealing gap is minimized. The pressure difference is only as large as the pressure difference between the suction segment and the pressure segment of the first compression stage. Owing to the small pressure difference, the leakage loss through the sealing gap is kept small, which has a positive effect on the efficiency of the compressor.

It is accepted that powerful forces act on the shaft of the compressor in the radial direction. Since the suction segment is arranged in the same angular segment of the compressor in the case of both compression stages, both compression stages exert a force in the same direction on the shaft. Thus, the invention contrasts with the common procedure, according to which machines are designed in such a way that the internal forces as far as possible cancel each other out. According to that approach, the suction segments of the two compression stages would be arranged offset by 180°, with the result that the forces are mutually opposed. However, the invention has recognized that it is possible to absorb the occurring forces by design measures and that the additional expense thereby entailed is small compared with the advantage obtained in terms of efficiency. If the two compression stages were turned through 180° relative to one another, essentially the entire pressure difference between two pressure stages would be applied across the sealing gap between the suction segment of the first compression stage and the pressure segment of the second compression stage. The reduction in efficiency would be considerable.

The two compression stages are preferably driven by a common shaft, with the result that the blades of the two compression stages move at the same angular velocity. The compressor can comprise a first control disk, which is associated with the first compression stage, and a second control disk, which is associated with the second compression stage. The control disks have suction slots, through which the gas to be compressed enters the chambers of the impeller. The control disks furthermore have pressure slots, through which the compressed gas reemerges from the chambers of the impeller. The suction slots are arranged in the suction segment of the compressor, and the pressure slots are arranged in the pressure segment of the compressor.

The two compression stages are preferably arranged between the first control disk and the second control disk. The impeller of the first compression stage can be provided at the opposite end from the first control disk with a wall which closes off the chambers in the axial direction and which rotates with the impeller. The impeller of the second compression stage can be provided at the opposite end from the second control disk with a wall which closes off the chambers in the axial direction. In each case, the wall preferably extends at least as far as the outer end of the blades.

The impeller of the first compression stage and the impeller of the second compression stage can be separated from one another, with the result that each of the two impellers has a wall of this kind. In a preferred embodiment, the impellers of the two compression stages are elements of an integral component. The integral component can be provided with a central partition wall, which simultaneously closes off the chambers of both compression stages. The chambers of the first compression stage can be arranged offset in the circumferential direction with respect to the chambers of the second compression stage. Both compression stages can have the same number of chambers.

The sealing gap can be formed between a circumferential surface of the wall and an end surface, adjacent thereto, of the housing. The radial clearance between the circumferential surface of the wall and the end surface of the housing is preferably less than 1 mm, preferably less than 0.5 mm, at room temperature. A sealing element made of a flexible material, which seals with both surfaces, can be arranged in the sealing gap.

The impeller of the first compression stage can have the same diameter as the impeller of the second compression stage. Thus, the invention differs from conventional compressors, in which two compression stages connected in series are normally provided with two different diameters to match the different pressure levels and compression ratings. The first compression stage is overdimensioned in relation thereto, thereby making it possible to keep the outlet pressure constant even with a reduced intake pressure.

The impeller of the first compression stage and the impeller of the second compression stage rotate within an internal space in the housing. The eccentric arrangement relates to this internal space. The diameter of the internal space can be the same size in the first compression stage as in the second compression stage. The internal space can have a uniform contour throughout the first compression stage and the second compression stage. For each angular position, it is then the case that the distance between the wall of the internal space and the center of the shaft is the same in the first compression stage as in the second compression stage.

The housing of the compressor can have a duct, which extends from the outlet side of the first compression stage to the inlet side of the second compression stage. In the axial direction, the duct preferably extends from the first control disk, via the impellers of the two compression stages, as far as the second control disk. The duct can furthermore comprise a segment which extends over a circumferential segment of at least 90°, preferably at least 120°, of the compressor. This enables the gas to be routed from the pressure slot of the first compression stage as far as the suction slot of the second compression stage, said suction slot being arranged in a different angular position.

The compressor can be designed in such a way that an inlet opening of the compressor adjoins the inlet side of the first compression stage. The inlet opening can be formed in a stub, which is provided with a flange connecting a pipe. The outlet side of the second compression stage can be adjoined by an outlet opening of the compressor, which can likewise be formed in a stub of this kind.

In a preferred embodiment, a third compression stage adjoins the outlet side of the second compression stage. The third compression stage preferably likewise comprises an impeller arranged in a housing. The impeller of the third compression stage can be driven by means of the same shaft as the impeller of the first compression stage and the impeller of the second compression stage. The third compression stage can be of double-acting design, which means that each chamber passes through two compression processes during one complete revolution. Thus, the third compression stage preferably comprises two suction segments and two pressure segments, which are offset by 180° relative to one another in each case. In the housing of the compressor, it is possible for a duct to be formed which extends from the pressure slot of the second compression stage as far as the suction slots of the first compression stage.

The impeller of the third compression stage can be enclosed between two control disks. In this case, the suction slots can be formed in one of the control disks and the pressure slots can be formed in the other control disk. The outlet opening of the compressor can adjoin the outlet side of the third compression stage.

The pressure difference between the first compression stage and the second compression stage gives rise to a considerable force in the axial direction. The compressor can be equipped with sufficiently stable main bearings to absorb these axial forces. In a preferred embodiment, the impeller of the third compression stage comprises a balance piston, which closes off a pressure balancing chamber in the axial direction. In particular, the hub of the impeller can be designed as a balance piston. The pressure in the pressure balancing chamber can be lower than on the outlet side of the third compression stage, preferably lower than on the inlet side of the third compression stage. In particular, the pressure balancing chamber can be connected by a duct to the inlet side of the first compression stage. The axial pressure on the shaft is considerably reduced by this measure.

The compressor preferably comprises a continuous shaft, which extends through all the compression stages. The shaft can be supported by means of a first main bearing and a second main bearing. The two main bearings can be arranged in such a way that they enclose between them all the compression stages. The shaft can be free from further bearings between the two main bearings.

One of the main bearings can be designed as a taper roller bearing, wherein the main bearing preferably has two taper roller bearings, which are oppositely oriented. A main bearing of this kind is well-designed for absorbing axial forces. The main bearing on the outlet side of the compressor is preferably designed as a taper roller bearing of this kind. On the inlet side of the compressor, it is possible to use a main bearing which has a lower capacity to absorb axial forces. The shaft is preferably held by the main bearings in such a way that it is free from play in the axial direction. The pressure-side end of the shaft is preferably arranged within the housing. The suction-side end of the shaft can project from the housing, allowing a drive motor to be connected there.

Since the impellers are operated with a very small clearance with respect to the control disks, the impellers should have a precisely defined position on the shaft. Spacer sleeves are preferably provided, and these are arranged between the shaft and the impellers and define the radial position of the impellers. The spacer sleeves can be made of a different material than the shaft. For example, the shaft can be made of simple steel and the spacer sleeve from high-grade steel.

The spacer sleeves are preferably designed in such a way that they match the shaft, i.e. are play-free in the radial direction and can be moved relative to the shaft in the axial direction. The spacer sleeves are likewise play-free in the radial direction and capable of movement in the axial direction within the impellers. Each impeller component can be enclosed between two spacer sleeves. For each spacer sleeve, the impeller components can have an offset, against which the spacer sleeve rests in the axial direction and which defines a precise axial position for the spacer sleeve. In relation to forces in the axial direction, this enables the impellers and the spacer sleeves to form a solid unit in which each element has a defined position. The position of this unit relative to the shaft can be defined, for example, by two shaft nuts, between which the unit is clamped. The unit preferably comprises two outer spacer sleeves and a central spacer sleeve, wherein the two impellers are each arranged between an outer spacer sleeve and the central spacer sleeve. The spacer sleeves can be designed as shaft protection sleeves, which prevent contact between the delivered medium and the shaft by means of suitable seals.

If the spacer sleeves are made of a different material than the shaft, stresses arise owing to different thermal expansion coefficients. In order to absorb such stresses in a controlled manner, one of the spacer sleeves can be provided with a weakening, with the result that the stresses lead to a deformation of the spacer sleeve in the region of the weakening. The other spacer sleeves are then not deformed, and therefore the impellers continue to be held in the defined position. The weakening can be designed, for example, as one or more grooves, which extend over the circumference of the spacer sleeve. A shaft on which an impeller is clamped between two spacer sleeves and on which one of the spacer sleeves has such a weakening forms an invention in its own right.

All the spacer sleeves which are arranged between an impeller and the inlet side of the compressor are preferably free from a weakening. The weakening is preferably applied to a spacer sleeve which is arranged between the impeller and a pressure-side end of the shaft.

In one embodiment of the invention, the sealing gap between the first compression stage and the second compression stage is deliberately used for supplying the operating fluid forming the fluid ring. For this purpose, the second compression stage is provided with a feed for operating fluid. Some of the operating fluid passes through the sealing gap into the first compression stage in order to form the fluid ring there. Apart from the sealing gap, the first compression stage can be free from a feed line for operating fluid. The quantity of operating fluid passing through the sealing gap is self-regulating since the pressure in the first compression stage falls when the quantity of operating fluid is too low. In this embodiment, it is not necessary to keep the sealing gap a small as possible; instead, the sealing gap can be set to match the desired flow of operating fluid. The efficiency increase is obtained from the fact that the operating fluid is fed in at a relatively high pressure instead of being delivered from the first compression stage to the second compression stage. Operating fluid at the required pressure is normally available from liquid separators arranged on the pressure side of the compressor.

The third compression stage can also be provided with a feed for operating fluid.

The compressor can be designed as a fluid ring compressor which is designed to output gas on the outlet side at a pressure significantly above atmospheric pressure. At an atmospheric pressure of about 1 bar, the outlet pressure is preferably higher than 8 bar, e.g. between 10 bar and 15 bar. In an embodiment with three compression stages, the pressure on the outlet side of the first compression stage can be between 2 bar and 3 bar, for example, and the pressure on the outlet side of the second compression stage can be between 4 bar and 6 bar. The compressor has a high suction capacity, for which reason it can also be operated with slight throttling without a significant drop in the pressure on the outlet side. For example, the pressure on the inlet side can be between 200 mbar and 500 mbar without the pressure on the outlet side falling below 10 bar. The invention furthermore relates to a method in which the compressor is used in these pressure ranges. As an alternative, the compressor can also be designed as a fluid ring vacuum pump which is designed to output the gas at approximately atmospheric pressure.

The compressor can be intended for use in large industrial plants, e.g. refineries, where high volume flows have to be processed. The compressor can be designed for a driving power of between 500 kW and 2 MW, for example.

The compressor can furthermore be designed to draw in a volume flow of between 800 $m^3/h$ and 3000 $m^3/h$ at atmospheric pressure. The diameter of the shaft can be between 15 cm and 30 cm, for example.

In the compressor, the compression of the gas takes place substantially isothermally since the gas is in intensive contact with the fluid ring during compression. The temperature of the emerging gas can be adjusted via the temperature of the fluid ring. Isothermal efficiency is defined as the quotient of the thermodynamic power additionally contained in the gas flow on the outlet side and the driving power on the shaft of the compressor when the temperature of the gas flow on the outlet side coincides with the temperature on the inlet side.

In the compressor, this isothermal efficiency is between 30% and 50%, preferably between 35% and 50%. In contrast, the isothermal efficiency of previous fluid ring compressors is of the order of 25% to 30%.

BRIEF DESCRIPTION OF THE DRAWINGS

The invention is described by way of example below by means of advantageous embodiments with reference to the attached drawings, in which.

DETAILED DESCRIPTION

Figure 1:
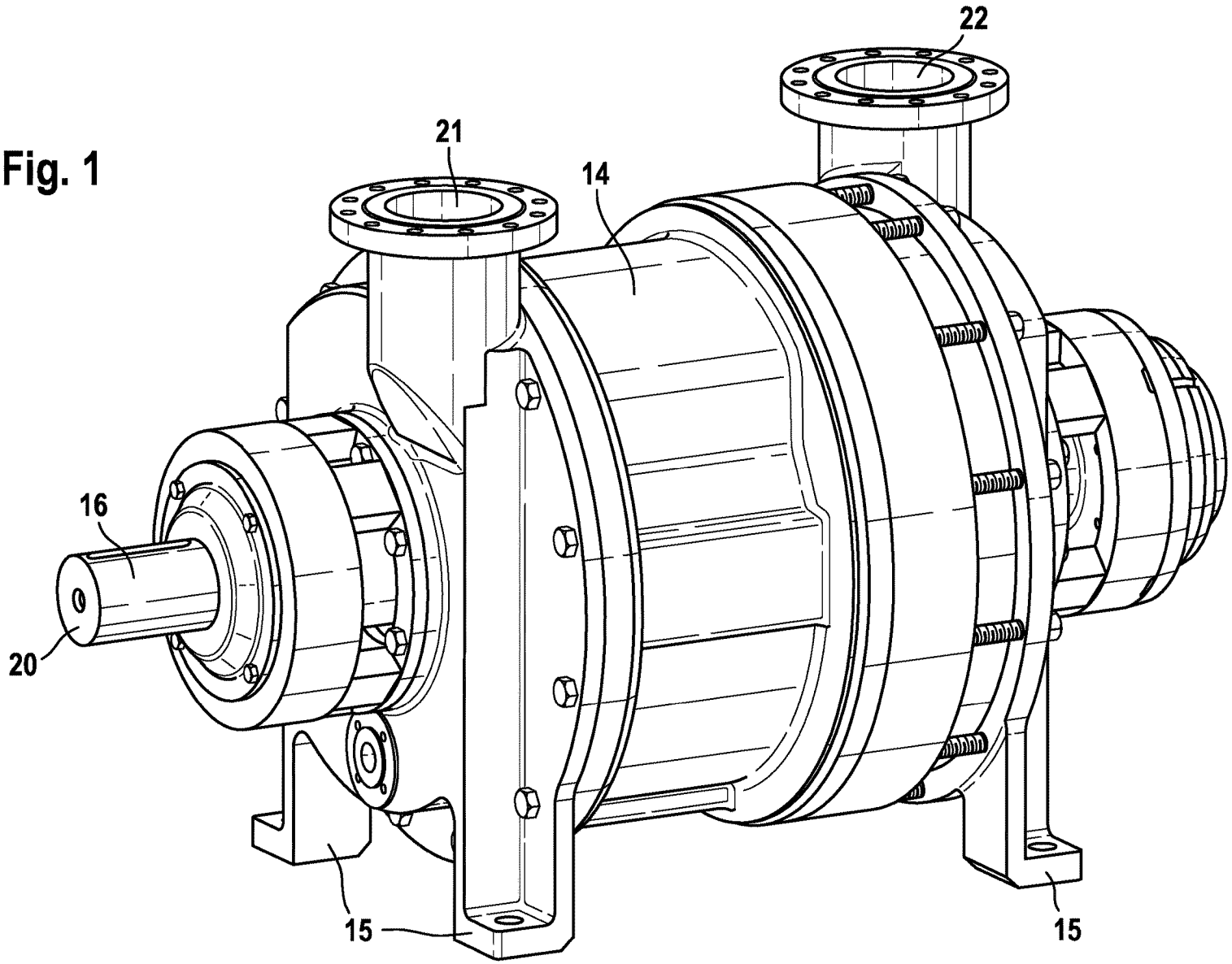
FIG. 1 shows a perspective view of a compressor.
Figure 2:
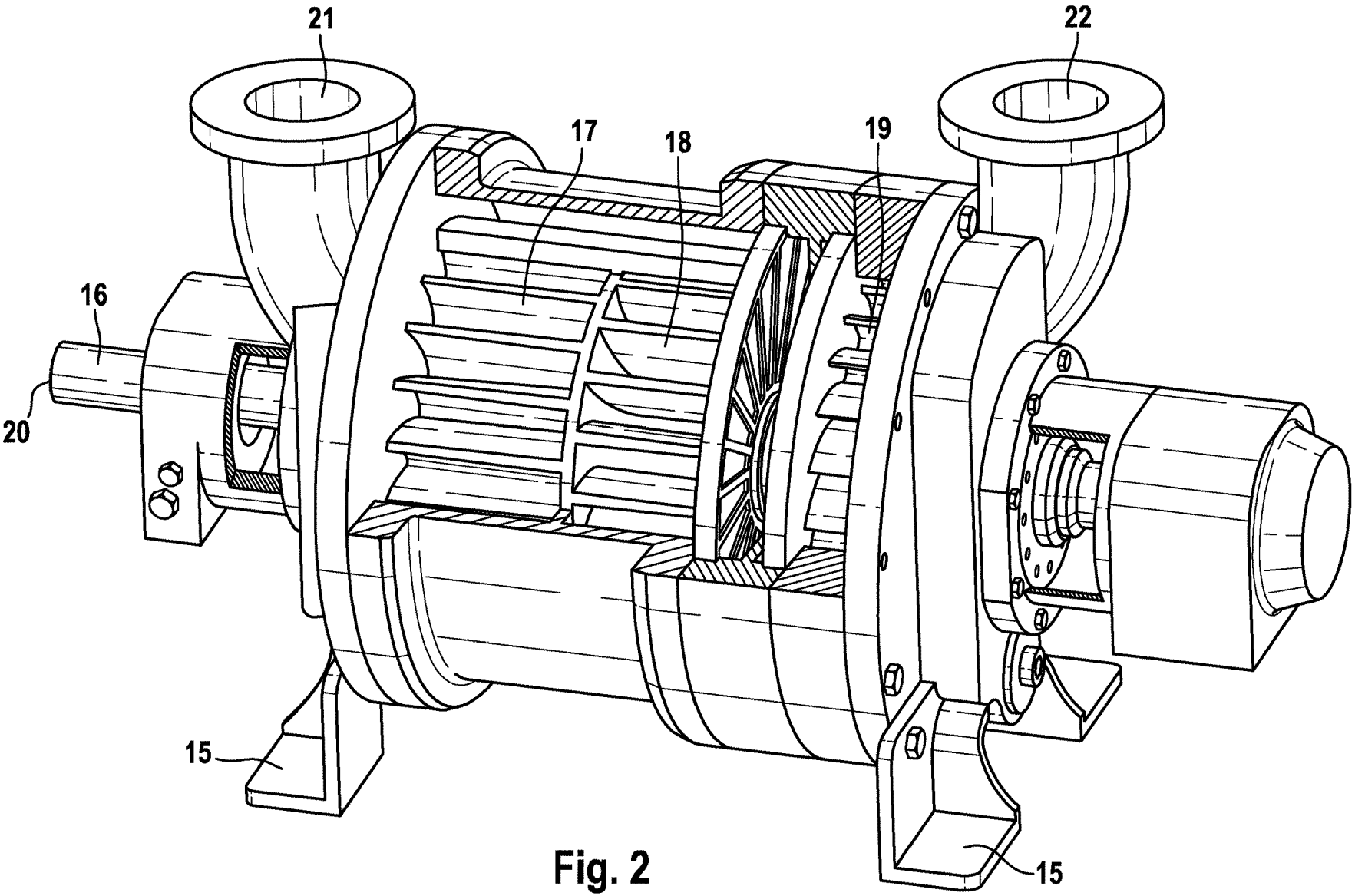
FIG. 2 shows a partially broken-way view of the compressor from FIG. 1.

A fluid ring compressor shown in FIGS. 1 and 2 comprises a housing 14, which stands on the ground via four legs 15 and in which a shaft 16 is rotatably mounted. The shaft 16 extends over the entire length of the compressor. By means of the shaft 16, the total of three compression stages 17, 18, 19 of the compressor is driven jointly.

A shaft journal 20 projecting from the housing 14 is used to connect a drive motor (not shown). The drive motor can have a power of 1 MW, for example. The opposite end of the shaft 16 is arranged within the housing 14.

The compressor comprises an inlet opening 21, which extends through a stub provided with a flange. The gas is drawn into the compressor through the inlet opening 21. The compressor furthermore comprises a correspondingly designed outlet opening 22, through which the compressed gas is discharged again. Compression is performed by the three compression stages 17, 18, 19, through which the gas flows in succession.

Figure 4:
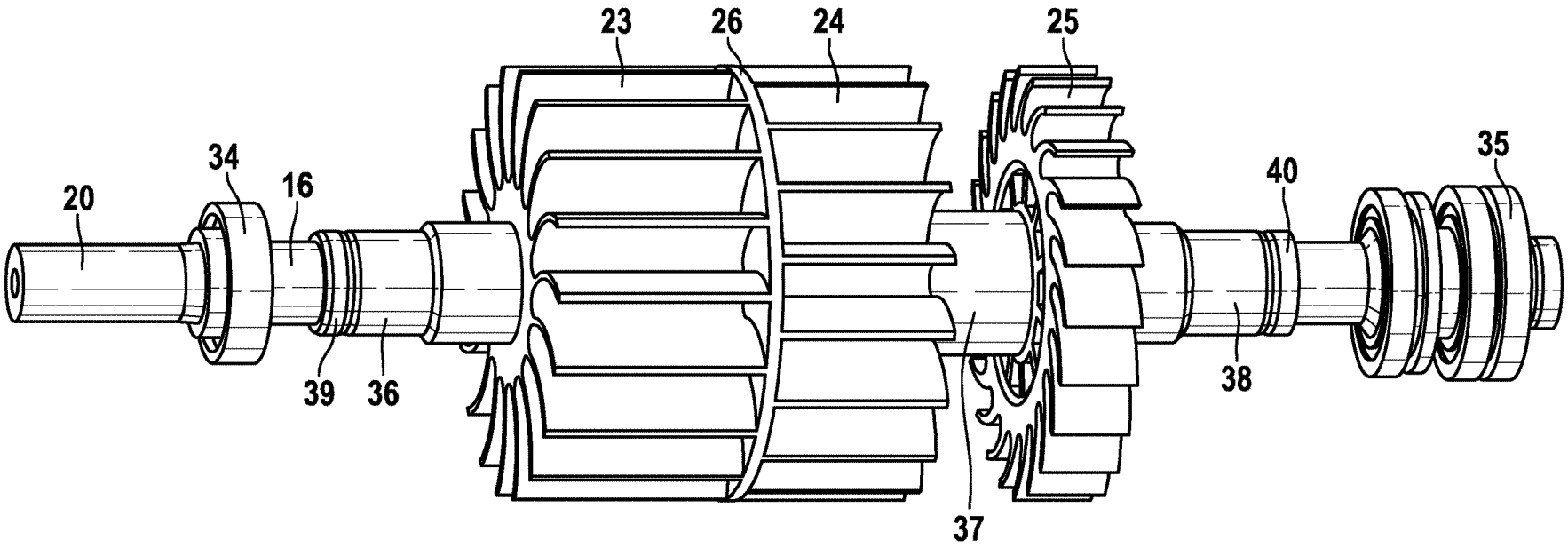
FIG. 4 shows a component of the compressor from FIG. 1.

Secured on the shaft 16 in FIG. 4 is an integral component, on which an impeller 23 of the first compression stage 17 and an impeller 24 of the second compression stage 18 are formed. The two impellers 23, 24 are separated from one another by a central wall 26. In addition, an impeller 25 of the third compression stage 19 is connected to the shaft 16. The impellers 23, 24, 25 rotate with the shaft 16 in the housing 14.

Figure 3:
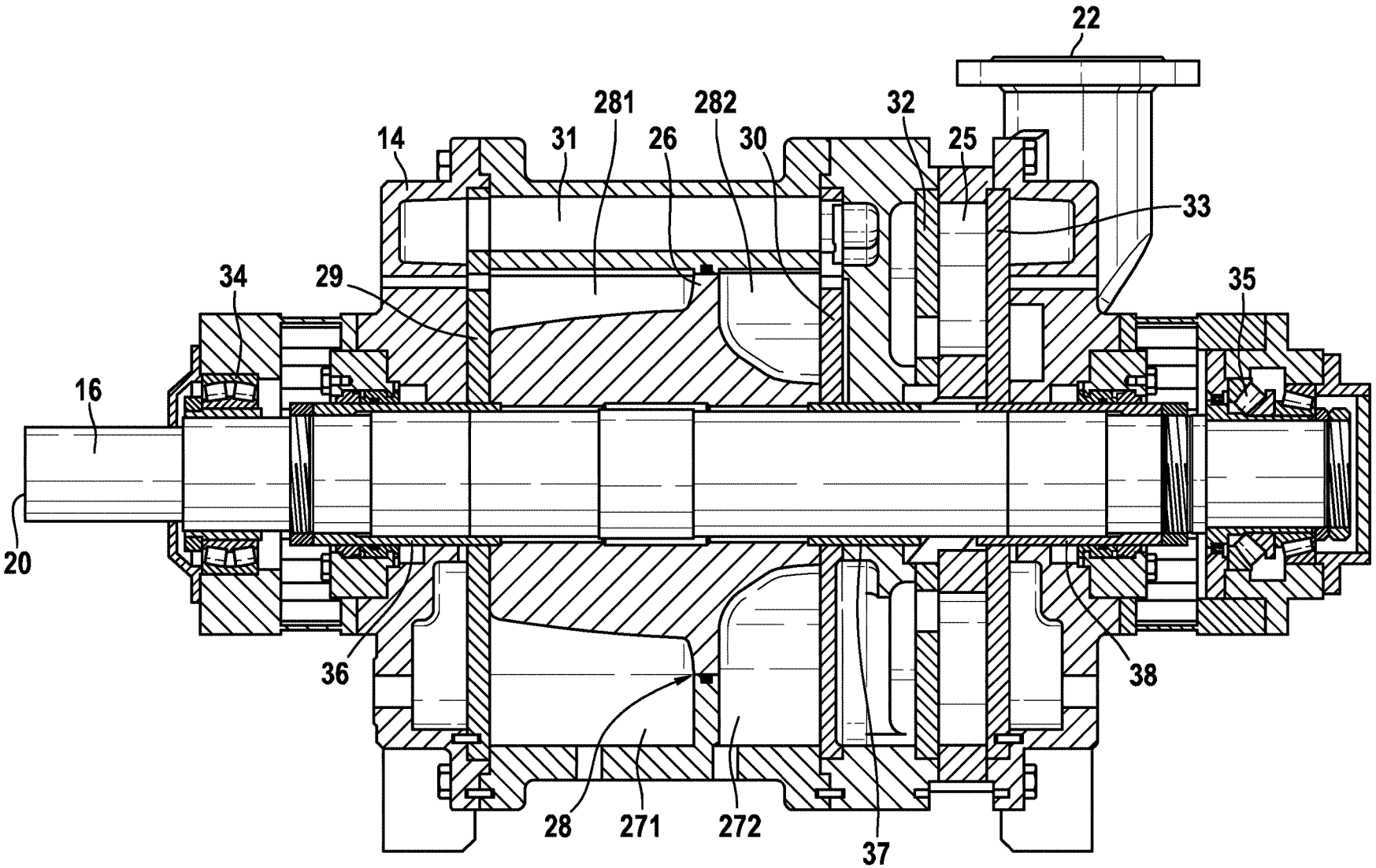
FIG. 3 shows a section through the compressor from FIG. 1.

The sectional view in FIG. 3 shows that the impellers 23, 24 are mounted eccentrically in the housing 14. The clearance between the shaft 16 and the upper end of the internal space surrounding the impellers 23, 24 is smaller than the clearance between the shaft 16 and the lower end of the internal space. The internal space has a uniform contour, and therefore the clearance between the shaft 16 and the wall of the internal space is the same in every angular position for the first compression stage 17 and the second compression stage 18. Thus, the chambers of the first impeller 23 have their minimum volume in the same angular position as the chambers of the second impeller 24. A corresponding statement applies to the maximum volume and to the intermediate positions.

The angular segment in which the volume of the chambers increases is referred to as the suction segment. The angular segment in which the volume of the chambers decreases is referred to as the pressure segment. In the sectional view in FIG. 3, the region situated below the shaft 16 belongs to the suction segment 271, 272 and the region situated above the shaft belongs to the pressure segment 281, 282. During one complete revolution, the impellers 23, 24 pass through precisely one suction segment 271, 272 and precisely one pressure segment 281, 282. Thus, the first compression stage 17 and the second compression stage 18 are single-acting. The compression process extends over more than 180°.

In the axial direction, the chambers of the impellers 23, 24 are each bounded by a control disk 29, 30. The control disks 29, 30 each have a suction slot in the suction segment 271, 272 and a pressure slot in the pressure segment 281, 282. The suction slot of control disk 29 is connected to the inlet opening 21 of the compressor. Gas drawn in through the inlet opening 21 passes through this suction slot into the chambers of impeller 23. As impeller 23 revolves, the volume of the chamber decreases and the compressed gas reemerges from the chambers of impeller 23 through the pressure slot of control disk 29. The compression process of the first compression stage 17 is thus complete. If the gas has been drawn in at an atmospheric pressure of 1 bar, the pressure at the outlet of the first compression stage can be between 2 bar and 3 bar, for example.

The compressed gas is passed from the pressure slot of control disk 29 to the suction slot of control disk 30 through a duct 31 formed in the housing 14. The gas passes through the suction slot into the chambers of impeller 24. As impeller 24 revolves, the gas is further compressed. The gas reemerges from the second compression stage 18 through the pressure slot of control disk 30 at a pressure of between 4 bar and 6 bar, for example.

The third impeller 25, which forms the third compression stage 19, is enclosed between a third control disk 32 and a fourth control disk 33. Control disk 32 comprises two suction slots offset by 180° relative to one another. Control disk 33 comprises two pressure slots offset by 180° relative to one another. The housing internal space surrounding the third impeller 25 is designed in such a way that it forms two suction segments and two pressure segments. In one complete revolution, impeller 25 thus passes through two suction segments and two pressure segments and therefore performs two compression processes. Each compression process extends over less than 180°, and the third compression stage is double-acting. The suction slots in control disk 32 are positioned in such a way that they offer access to the suction segments. Correspondingly, the pressure slots in control disk 33 are positioned in such a way that they offer access to the pressure segments.

From the outlet of the second compression stage 18, the gas is passed to the suction slots in control disk 32, thus allowing it to enter the chambers of impeller 25. After the compression process, the gas emerges from the third compression stage through the pressure slots of control disk 33 at a pressure of between 10 bar and 15 bar, for example. From there, the gas is passed out of the compressor through the outlet opening 22.

Owing to the pressure difference between the first compression stage 17 and the second compression stage 18, a leakage flow can form between the chambers of the second impeller 24 and the chambers of the first impeller 23. The leakage flow passes through a sealing gap 28, which exists between the partition wall 26 of impellers 23, 24 and the surrounding housing. In order to keep down leakage flow, the radial clearance between the partition wall 26 and the housing is kept as small as possible, and a sealing ring is furthermore arranged in the sealing gap 28. However, it is not possible to completely avoid the leakage flow by these measures.

A further contribution to reducing the leakage flow is made by the fact that the suction segments 271, 272 and the pressure segments 281, 282 of the first compression stage 17 and the second compression stage 18 are each arranged at the same angular position. As a result, the pressure difference between the first compression stage 17 and the second compression stage 18 is approximately the same in all angular positions and is of the order of a mere 2 bar to 3 bar. This small pressure difference likewise counteracts the formation of a high leakage flow.

However, the corresponding angular position of the suction segments 271, 272 and pressure segments 281, 282 in the first two compression stages 17, 18 also has the effect that large forces act on the shaft 16 in the radial direction. These forces are absorbed by making the shaft 16 very massive. For example, the shaft can be made of steel and can have a diameter of 20 cm. This dimensioning has proven sufficient to prevent the shaft 16 bending excessively under the forces exerted by the impellers 23, 24.

Owing to the pressure difference between the chambers of impeller 24 and the chambers of impeller 23, there is furthermore a large force acting in the axial direction on the shaft 16, said force being directed to the left in FIG. 3. These forces are absorbed by a main bearing 35 of large dimensions. The main bearing 35 is designed as a taper roller bearing, which can absorb not only the radial forces but also large axial forces. The second main bearing 34 absorbs primarily radial forces. The shaft 16 has no further support between the two main bearings 34, 35.

In order to keep down the leakage flow within the respective compression stages 17, 18, 19, it is furthermore desired that the blades of the impellers 23, 24, 25 should move with the smallest possible clearance relative to the control disks 29, 30, 32, 33. This, in turn, presupposes that the impellers 23, 24, 25 are held with high accuracy in a particular position on the shaft 16. In the compressor, this is accomplished by arranging spacer sleeves 36, 37, 38 between the impellers and the shaft 16, said spacers defining a precise position in the radial direction.

The spacer sleeves 36, 37, 38 furthermore define precise positions in the axial direction since they rest in the axial direction against suitable projections on the impellers 23, 24, 25. The unit comprising the spacer sleeves 36, 37, 38 and impellers 23, 24, 25 is clamped together in the axial direction by means of two shaft nuts 39, 40, with the result that all the elements have a precisely defined position.

Figure 6:
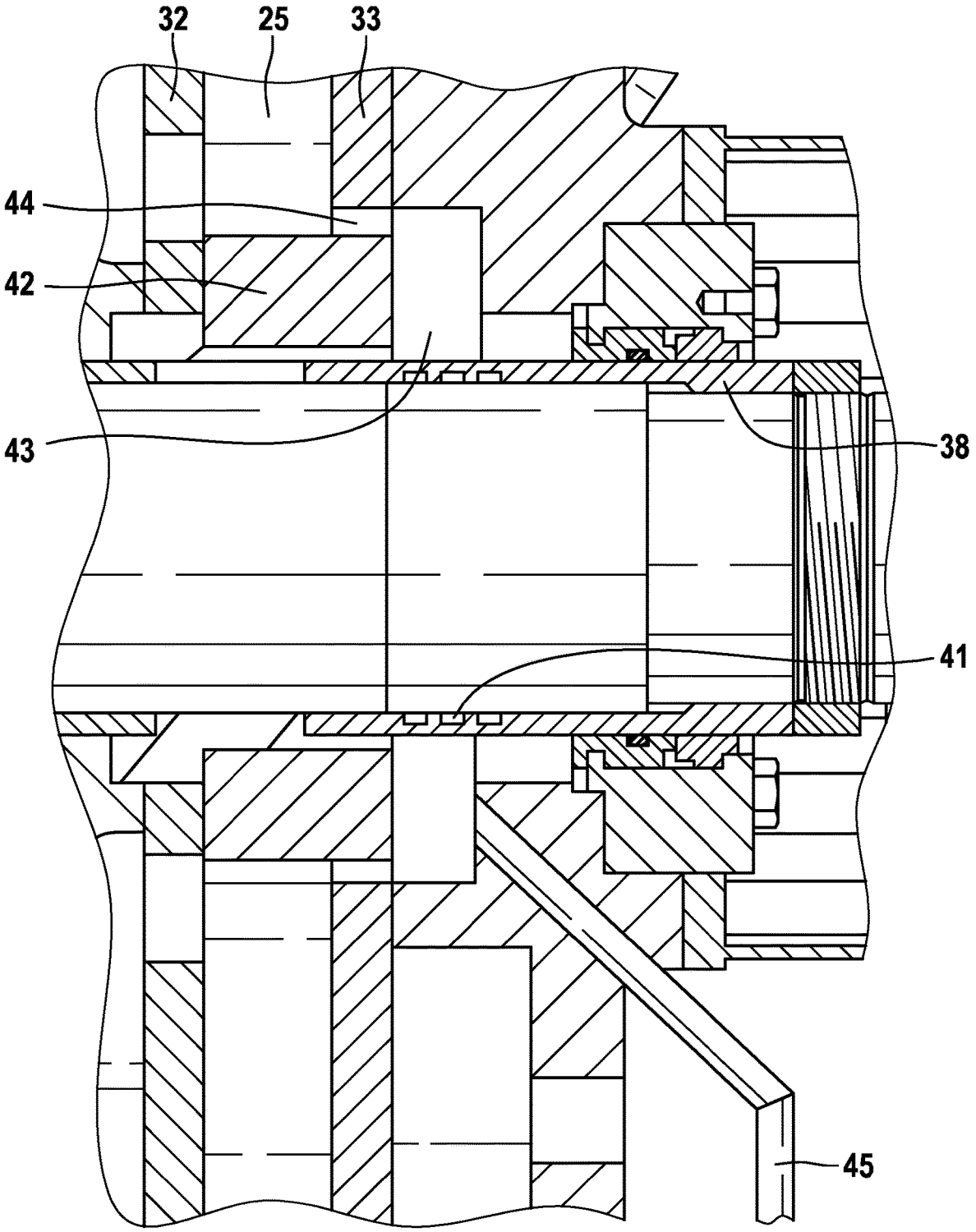
FIG. 6 shows an enlarged detail of FIG. 5.

The spacer sleeves 36, 37, 38 are made of high-grade steel and hence from a different material than the shaft 16. When the compressor heats up, stresses may arise owing to the different thermal expansion coefficients. In order to absorb these in a controlled manner, spacer sleeve 38, which is arranged between the third impeller 25 and the pressure-side main bearing 35, is provided with internal grooves 41, which are shown in the enlarged illustration in FIG. 6. The grooves 41 form a weakening of spacer sleeve 38, with the result that deformation occurs due to thermal expansion in this region. This targeted deformation ensures that the axial position of the impellers 23, 24, 25 shifts only very slightly when the compressor heats up.

Figure 5:
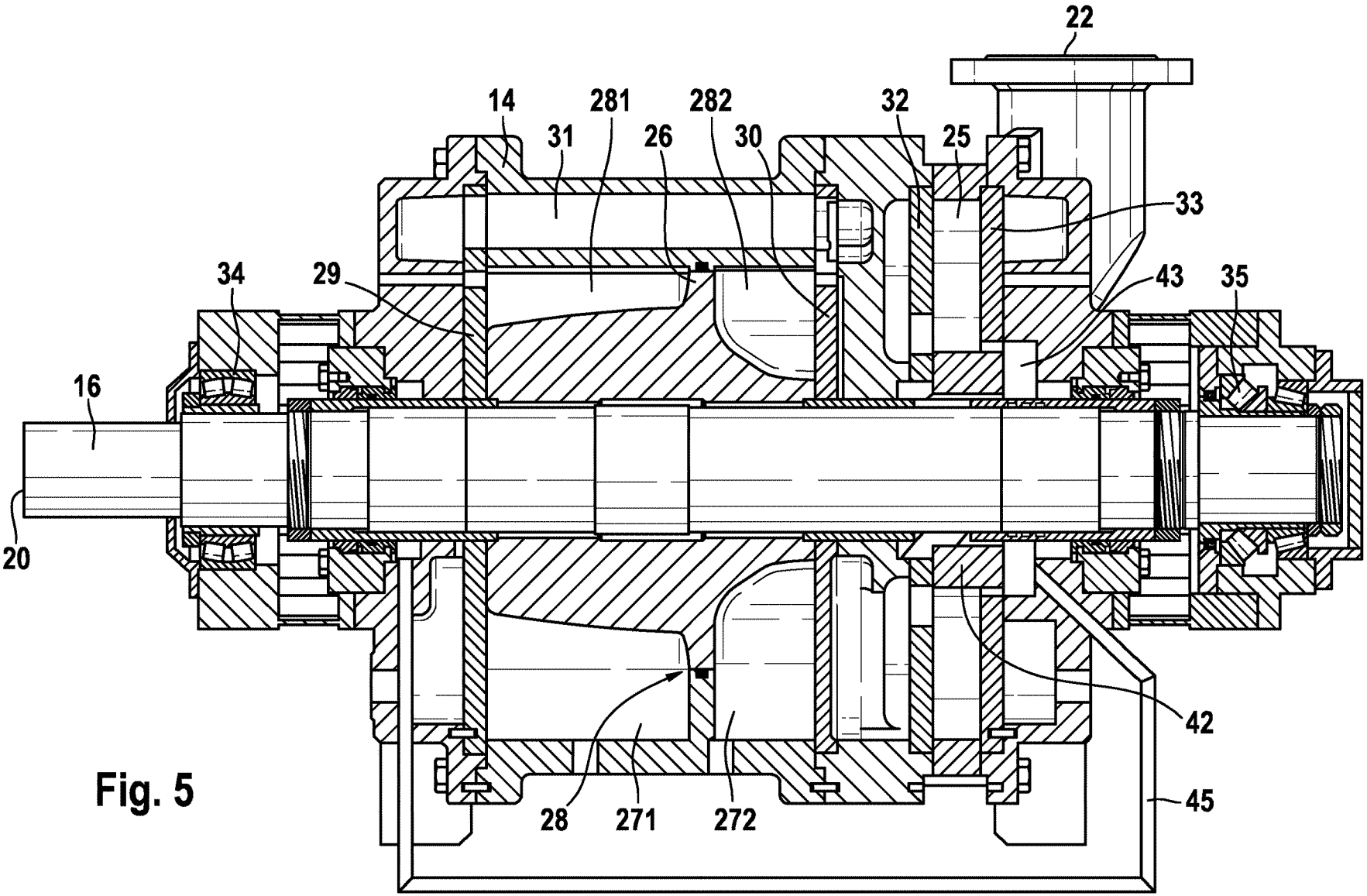
FIG. 5 shows a section through an alternative embodiment of a compressor.

In the alternative embodiment shown in FIG. 5, the hub 42 of impeller 25 is designed as a balance piston in order to reduce the axial pressure on the shaft 16. In the direction of the pressure side, the hub 42 is adjoined by a cylindrical cavity 43, which is sealed off with respect to the hub 42 by a sealing gap 44. The cavity 43 is connected by a line 45 to the suction side of the compressor, on which the pressure is substantially atmospheric pressure. Since the atmospheric pressure is passed to the outlet side of the third compression stage 19, the axial pressure is reduced and the shaft 16 is relieved of load.

The second compression stage 18 and the third compression stage 19 are each connected to a feed line (not shown) for operating fluid, these being supplied by a liquid separator arranged on the pressure side of the compressor. The first compression stage 17 does not have a direct feed for operating fluid. Instead, the first compression stage is supplied with operating fluid via the sealing gap 28. The diameter of the sealing gap is chosen so that the desired flow of operating fluid is established.

The invention claimed is:

1. A fluid ring compressor having a first single-acting compression stage, which has a first impeller eccentrically mounted in a housing, and a second single-acting compression stage, which has a second impeller eccentrically mounted in the housing, wherein the first compression stage and the second compression stage are separated from one another by a sealing gap, characterized in that the sealing gap is arranged between a suction segment of the first compression stage and a suction segment of the second compression stage, the suction segment of the first compression stage extends across a first circumferential section of the compressor and the suction segment of the second compression stage extends across a second circumferential section of the compressor, wherein the suction segment of the first compression stage and the suction segment of the second compression stage adjoin each other and the first and second circumferential sections overlap one another.

2. The fluid ring compressor as claimed in claim 1, characterized in that the first compression stage has a first control disk, in that the second compression stage has a second control disk, wherein the first impeller and the second impeller are arranged between the first control disk and the second control disk.

3. The fluid ring compressor as claimed in claim 1, wherein the first impeller has chambers and the second impeller has chambers characterized in that a wall, which rotates with the impellers, is formed between the chambers of the first impeller and the chambers of the second impeller.

4. The fluid ring compressor as claimed in claim 3, characterized in that the sealing gap is arranged between a circumferential surface of the wall and an end surface of the housing.

5. The fluid ring compressor as claimed in claim 1, characterized in that the housing has a duct, which extends from an outlet side of the first compression stage to an inlet side of the second compression stage.

6. The fluid ring compressor as claimed in claim 1, wherein the first impeller and the second impeller are driven by a shaft characterized in that a third compression stage adjoins an outlet side of the second compression stage, wherein an impeller of the third compression stage is driven by means of said shaft.

7. The fluid ring compressor as claimed in claim 6, characterized in that the third compression stage is of double-acting design.

8. The fluid ring compressor as claimed in claim 6, characterized in that the impeller of the third compression stage is arranged between a first control disk and a second control disk and in that suction slots are formed in the first control disk and pressure slots are formed in the second control disk.

9. The fluid ring compressor as claimed in claim 6, characterized in that the impeller of the third compression stage has a balance piston, which closes off a pressure balancing chamber in an axial direction, wherein the pressure in the pressure balancing chamber is lower than on an outlet side of the third compression stage.

10. The fluid ring compressor as claimed in claim 1, characterized in that each impeller component is enclosed between two spacer sleeves in an axial direction.

11. The fluid ring compressor as claimed in claim 10, characterized in that one of the spacer sleeves is deformable.

12. The fluid ring compressor as claimed in claim 1, characterized in that the second compression stage is equipped with a feed for operating fluid, and in that the first compression stage is free from a feed line for operating fluid.

13. The fluid ring compressor as claimed in claim 1, and further comprising a third compression stage characterized in that the third compression stage is equipped with a feed for operating fluid.

14. The fluid ring compressor as claimed in claim 1, characterized in that it drives power of between 500 kW and 2 MW.

15. The fluid ring compressor as claimed in claim 2, wherein the first impeller has chambers and the second impeller has chambers characterized in that a wall, which rotates with the impellers, is formed between the chambers of the first impeller and the chambers of the second impeller.

16. The fluid ring compressor as claimed in claim 2, characterized in that the housing has a duct, which extends from an outlet side of the first compression stage to an inlet side of the second compression stage.

17. The fluid ring compressor as claimed in claim 3, characterized in that the housing has a duct, which extends from an outlet side of the first compression stage to an inlet side of the second compression stage.

18. The fluid ring compressor as claimed in claim 4, characterized in that the housing has a duct, which extends from an outlet side of the first compression stage to an inlet side of the second compression stage.

19. The fluid ring compressor as claimed in claim 2, wherein the first impeller and the second impeller are driven by a shaft characterized in that a third compression stage adjoins an outlet side of the second compression stage, wherein an impeller of the third compression stage is driven by means of said shaft.

20. The fluid ring compressor as claimed in claim 3, wherein the first impeller and the second impeller are driven by a shaft characterized in that a third compression stage adjoins an outlet side of the second compression stage, wherein an impeller of the third compression stage is driven by means of said shaft.

21. A fluid ring compressor having a first single-acting compression stage, which has a first impeller eccentrically mounted in a housing, and a second single-acting compression stage, which has a second impeller eccentrically mounted in the housing, the first impeller and the second impeller driven by a shaft, wherein the first compression stage and the second compression stage are separated from one another by a sealing gap, characterized in that the sealing gap is arranged between a suction segment of the first compression stage and a suction segment of the second compression stage and the suction segment of the first compression stage and the suction segment of the second compression stage adjoin each other and are arranged on a same side of the shaft.

* * * * *